US006041616A

United States Patent [19]

Jeong

[11] Patent Number: 6,041,616

[45] Date of Patent: Mar. 28, 2000

[54] COOL AIR CIRCULATION APPARATUS IN A REFRIGERATOR

[75] Inventor: Jae-Youk Jeong, Incheon, Rep. of Korea

[73] Assignee: Daewoo Electronics Co., Ltd., Seoul, Rep. of Korea

[21] Appl. No.: 09/210,732

[22] Filed: Dec. 15, 1998

[30] Foreign Application Priority Data

Nov. 9, 1998 [KR] Rep. of Korea ..... 98-21674

[51] Int. Cl.[7] ..... F25D 17/08

[52] U.S. Cl. ..... 62/419; 62/256

[58] Field of Search ..... 62/256, 407, 408, 62/419, 441; 454/193

[56] References Cited

U.S. PATENT DOCUMENTS

| | | | |
|---|---|---|---|
| 3,130,559 | 4/1964 | Beckwith | 62/256 |
| 3,827,254 | 8/1974 | MacMaster et al. | 62/256 |
| 4,326,385 | 4/1982 | Ibrahim | 62/82 |
| 5,475,987 | 12/1995 | McGovern | 62/256 |
| 5,765,388 | 6/1998 | Jeon | 62/408 |
| 5,784,985 | 7/1998 | Choi | 62/407 |
| 5,809,799 | 9/1998 | Jeong | 62/408 |

FOREIGN PATENT DOCUMENTS

| | | |
|---|---|---|
| 0248370 | 12/1987 | European Pat. Off. . |
| 3002778 | 8/1980 | Germany . |

*Primary Examiner*—William E. Tapolcai
*Attorney, Agent, or Firm*—Smith, Gambrell & Russell, LLP

[57] ABSTRACT

A cool air circulation apparatus in a refrigerator provides an upper curved lip extended from a front face of a lower shelf in a refrigerating chamber, by which cool air contacting with ambient air is discharged outside of the refrigerator and only the cool air adjacent to the refrigerating chamber flows into the refrigerating chamber. Accordingly, even though a door of the refrigerating chamber is open for a long time or is opened and closed frequently, ambient air does not enter into the refrigerating chamber and thus cooling efficiency of the refrigerator increases. As a result, a constant temperature in the refrigerating chamber is maintained at all times, thereby being capable of maintaining freshness of a stored foods for a long time.

4 Claims, 5 Drawing Sheets

COOL AIR CIRCULATION APPARATUS IN A REFRIGERATOR

BACKGROUND OF THE INVENTION

1. Field of the Invention

The present invention relates to a cool air circulation apparatus in a refrigerator. More specifically, the invention relates to a cool air circulation apparatus in a refrigerator having an upper curved lip formed at a front face of a lower shelf, by which the cool air contacting with ambient air is discharged outside of the refrigerator and only the cool air adjacent to a refrigerating chamber flows into the refrigerating chamber.

2. Prior Art

A conventional refrigerator is illustrated in FIG. 1 and FIG. 2, which comprises a freezing chamber 1 and a refrigerating chamber 2. A compressor 10 is mounted on a rear lower portion of the refrigerator, and an evaporator 20 is provided at a rear portion of the freezing chamber 2. A refrigerant is compressed by operation of the compressor 10, and the compressed refrigerant flows toward the evaporator 20, thereby cooling the circulating air by the evaporation of the refrigerant.

Fans 23, 24 for circulating cool air are provided at the rear portion of the freezing chamber 1, and the air cooled through the evaporator 20 is supplied to the freezing chamber 1 and the refrigerating chamber 2 via each cool air duct which will be illustrated later.

The cool air duct 25 is provided in a rear portion of the freezing chamber 1, and the cool air forcedly enters into the cool air duct 25 by the operation of the fan 23, and further enters into the freezing chamber 1 through a plurality of openings 27 formed at a duct cover 25C provided between the freezing chamber 1 and the evaporator 20.

Another cool air duct 26 is formed behind the cool air duct 25 opposite to the freezing chamber 1. The duct 26 is branched in two passages 26A, 26B, preferably, and each passage is further extended down along each rear side of the refrigerating chamber 2. The cool air forcedly enters into each passage 26A, 26B by the operation of another fan 24, and further enters into the refrigerating chamber 2 through a plurality of openings 28 formed at a duct cover 26C. Preferably, other openings 29 channeled from corresponding passages 26A, 26B are provided at each inner side wall of the refrigerating chamber 2.

A cool air supply duct 42 is arranged under a partition wall 41 divided from the freezing chamber 1 and the refrigerating chamber 2, which extends from the rear portion of the refrigerating chamber 2 to the front portion of the refrigerating chamber 2. A chamber 42*a* for housing an air curtain fan 44 is formed at one end of the duct 42 proximal to the rear portion of the refrigerating chamber 2, and an air discharge opening 43 is formed at another end of the duct 42 opposite to the chamber 42*a*. The air discharge opening 43 is preferably formed along the entire width of the upper portion of an accessible opening 2C of the refrigerating chamber 2.

The fan 44 for generating the air curtain stream is housed in the chamber 42*a*, thereby enabling the air to flow smoothly. Preferably, the length of the fan 44 corresponds to the inner width of the chamber 42*a*, and is operated by additional motor 46.

Since the upper surface of the duct 42 is flatly extended, and the lower surface of the duct 42 is sloped up to the air discharge opening 43, the cross-section area of the duct 42 is decreased more and more toward the opening 43. The velocity of the cool air flowing along near the upper inner surface of the air duct 42 is faster than that of the air along the lower inner surface of the air duct 42. A front end of the bent discharge opening 43 of the duct 42 is straight which causes the discharging cool air to flow straight.

An air collecting duct 47 is extended down a long a rear center portion of the refrigerating chamber 2, and plural air collecting openings 48, 48A, 48B channeled from the air collecting duct 47 are formed at a duct cover 47C.

The refrigerating chamber 2 is divided by plural shelves 49, 49A, 49B, the upper surface of which is preferably flat-shaped to enhance effective air collection. A cross-section area of the opening 48 formed at the uppermost area of the refrigerating chamber 2 is smaller than that of the opening 48A formed at the middle height area of the refrigerating chamber 2, and a cross-section area of the opening 48A is smaller than that of the opening 48B formed at the lower height area of the refrigerating chamber 2. Height of each opening 48, 48A, 48B is determined according to volume of storage foodstuffs, but each opening 48, 48A, 48B is preferably formed at approximately halfway up each shelf 48, 48A, 48B. Further, each opening 48, 48A, 48B has a rectangular shape having a long longitudinal side or an oval shape.

The operation of the refrigerator configurated above is illustrated as follows. When a door (not shown) is opened, the fan 44 commences operation, and simultaneously the fan 24 terminates operation. The cool air is discharged through the opening 43 by the operation of the fan 44, thus forming the cool air curtain. The cool air circulating in the refrigerating chamber 2 does not escapes from the refrigerating chamber 2, thereby maintaining a constant temperature of the refrigerating chamber 2.

However, even if the cool air discharged from the opening 43 has the same low temperature between the distal layer and the proximal layer to the refrigerating chamber, the temperature of the distal layer of the air curtain increases greatly while the air stream flows downward in contact with ambient temperature air. Therefore, the air curtain flow has high temperature and the air enters into the refrigerating chamber. The high temperature air further flows into each air collecting opening, and recirculates in the refrigerating chamber. Thus, there is a problem in that the temperature of the refrigerating chamber increases, causing a decline in the cooling efficiency of the refrigerator.

THE SUMMARY OF THE INVENTION

To solve the above problems, it is a first object of the present invention to provide a cool air circulation apparatus in a refrigerator, which effectively prevents ambient air from entering into a refrigerating chamber.

It is a second object of the present invention to provide a cool air circulation apparatus in a refrigerator forming an upper curved lip at a front face of a lower shelf in a refrigerating chamber, by which the cool air of air curtain contacting with ambient air is discharged outside of the refrigerator and only the cool air of the air curtain not contacting with ambient air flows into the refrigerating chamber, thereby preventing temperature of the refrigerator from rising.

To obtain these objects, a cool air circulation apparatus in a refrigerator comprises a refrigerator having an access opening at a front portion, in which a plurality of shelves are transversely provided in stacking type; a cool air supply duct installed on an upper portion of the access opening and discharging the cool air from the upper portion of the access opening toward a lower portion of the access opening, wherein the cool air supply duct is divided into an upper air passage and a lower air passage having a cross-section larger than that of the upper air passage by a partition plate longitudinally extended in the cool air supply duct; a cross flow fan installed in an inlet part of the cool air supply duct and forcedly ventilating the cool air; a cool air collecting duct, one side of which is extended toward the cross flow fan and another side of which is communicated with a plurality of cool air collecting openings formed between the shelves; and an upper curved lip facing the cool air supply duct at a front face of the lowest shelf among the shelves, thereby guiding one portion of the cool air into the refrigerating chamber.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE PREFERRED EMBODIMENT

Hereinafter, a first preferred embodiment according to the present invention will be described in detail with reference to the drawings.

Figure 1:
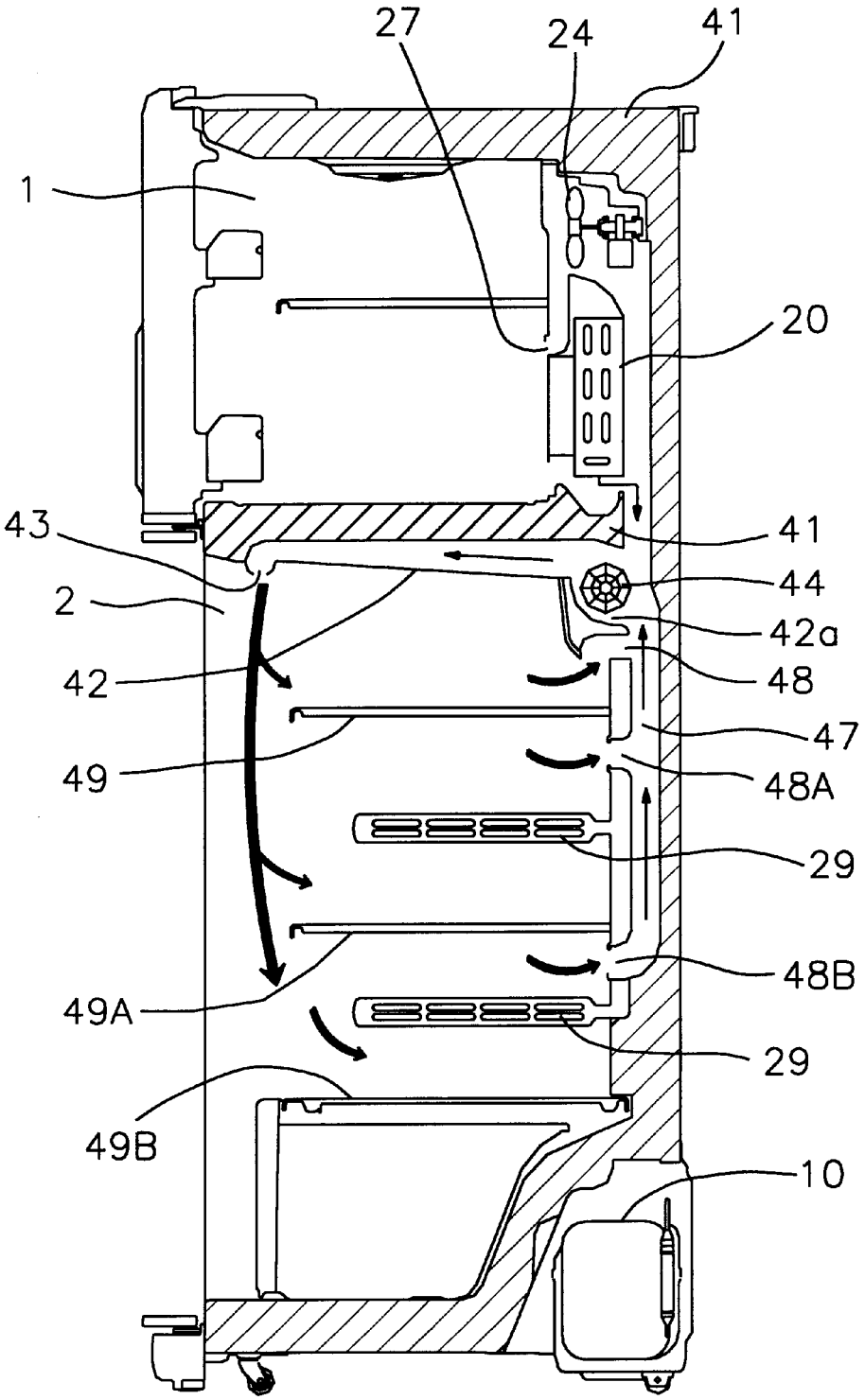
FIG. 1 PRIOR ART
FIG. 1 is a side vertical cross-sectional view of a refrigerator having air curtain flow according to a prior art.
Figure 2:
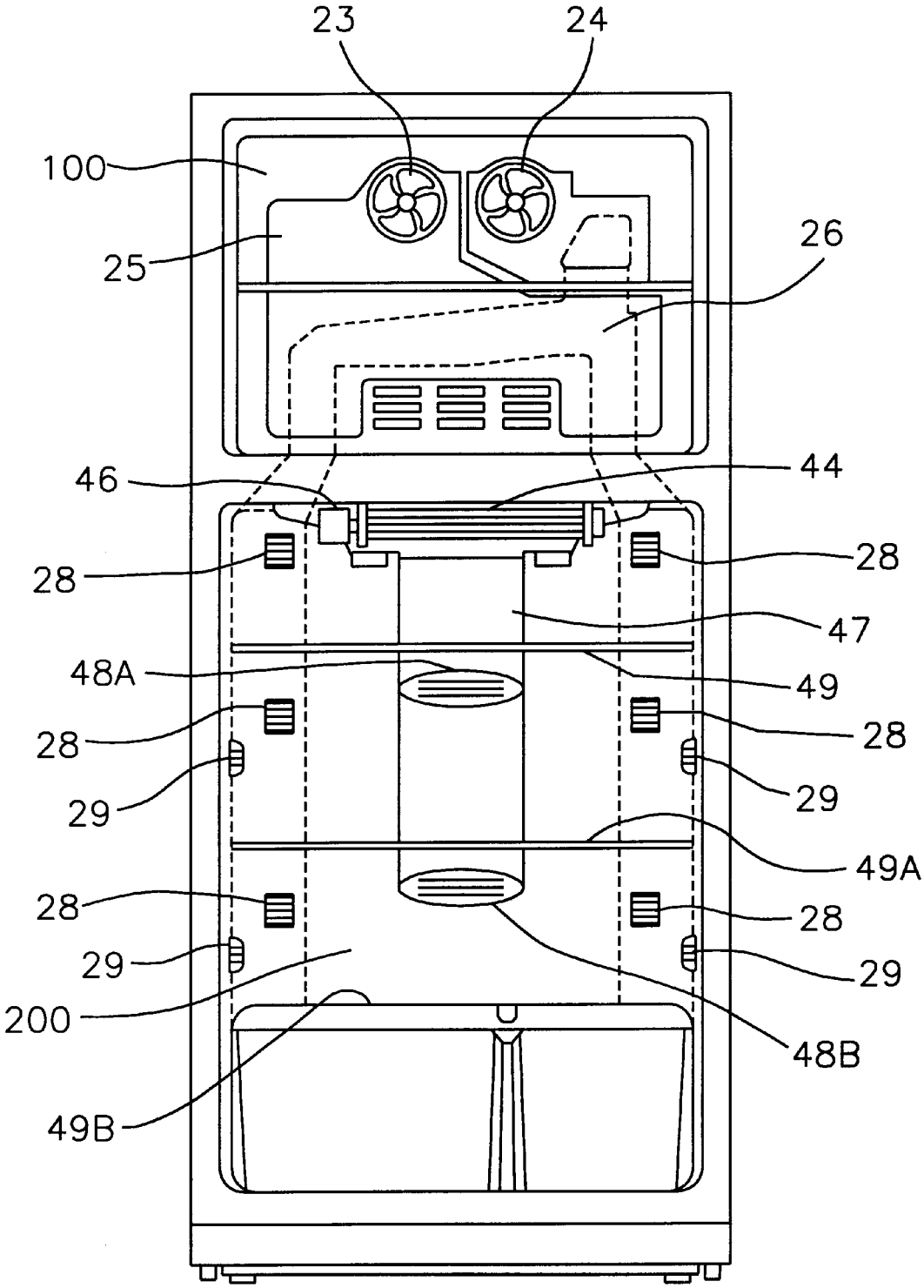
FIG. 2 PRIOR ART
FIG. 2 is a front view of a refrigerator having air curtain flow of FIG. 1.
Figure 3:
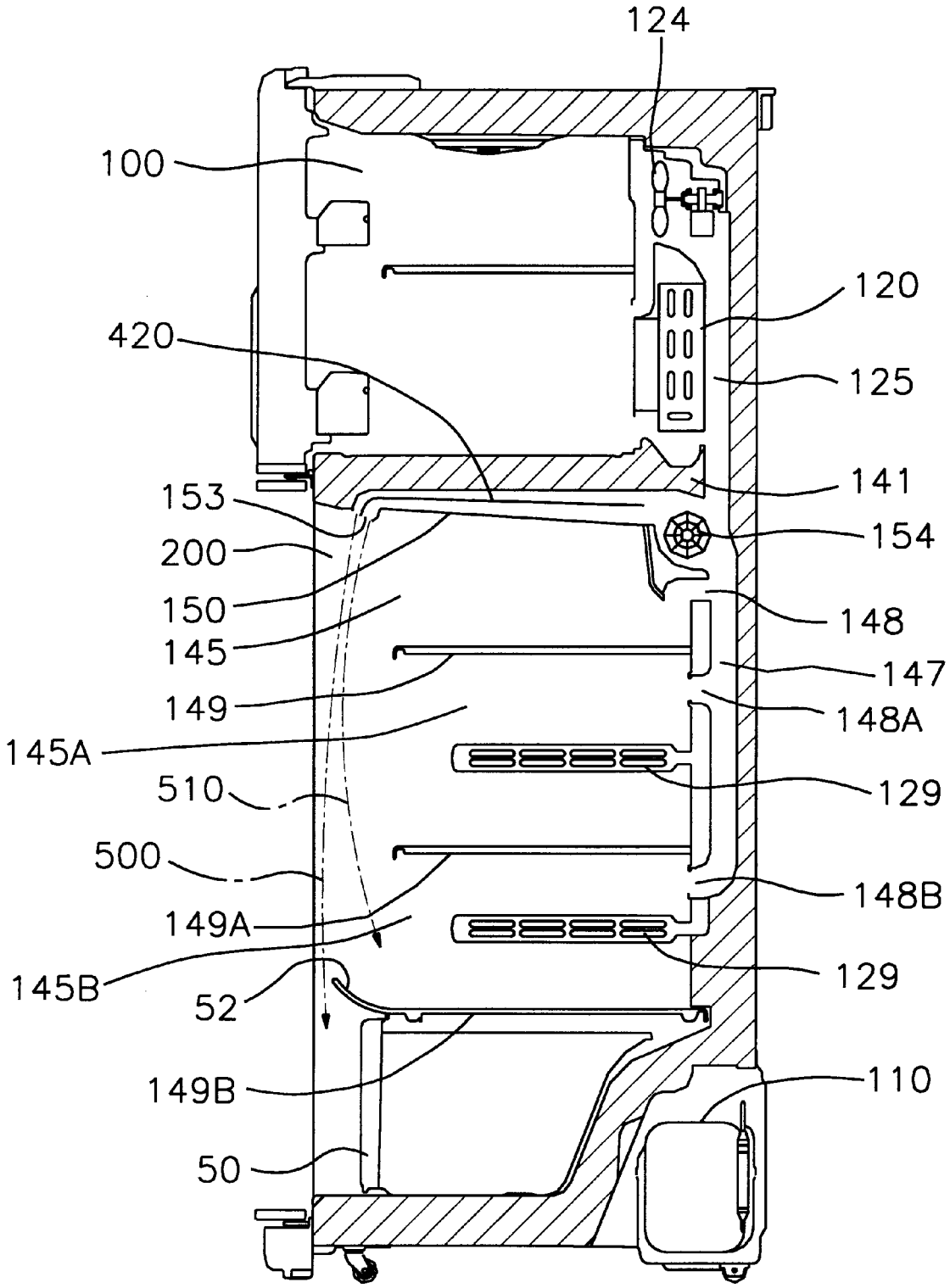
FIG. 3 is a side vertical cross-sectional view of a refrigerator having cool air circulation apparatus according to a present invention.

FIG. 3 is a side vertical cross-sectional view of a refrigerator having cool air circulation apparatus according to a present invention.

As shown in FIG. 3, a refrigerator having a cool air circulation apparatus according to a preferred embodiment of the present invention comprises a freezing chamber 100 and a refrigerating chamber 200. A compressor 110 is mounted on a rear lower portion of the refrigerator, and an evaporator 120 is provided at a rear portion of the freezing chamber 200. A refrigerant is compressed by operation of the compressor 110, and the compressed refrigerant flows toward the evaporator 120, thereby cooling the circulating air by the evaporation of the refrigerant.

A fan 124 for circulating cool air is provided at the rear portion of the freezing chamber 100, and the air cooled through the evaporator 120 is supplied to the refrigerating chamber 200 via cool air duct 125 which will be illustrated later.

The cool air duct 125 is provided in a rear portion of the freezing chamber 1, and a plurality of openings 129 communicated with the cool air duct 125 are formed at each inner wall of the refrigerating chamber 200.

Furthermore, a partition wall 141 made from an insulating member is provided between the freezing chamber 100 and the refrigerating chamber 200 for maintaining their temperature difference.

A cool air supply duct 150 is arranged under the partition wall 141 for forming air curtain stream on an access opening of the refrigerating chamber 200 through the discharging operation of the cool air, which extends from the rear portion of the refrigerating chamber 200 to the front portion of the refrigerating chamber 200.

A cross flow fan 154 is installed in the rear portion of the cool air supply duct 150, and an exit 153 is provided at the front portion of the cool air supply duct 150. The cross flow fan 154 forcedly ventilates the cool air in the cool air duct 125 toward the front portion of the cool air supply duct 150, and the exit 153 draws the ventilated cool air into the access opening of the refrigerating chamber 200.

The cross flow fan 44 for generating the air curtain stream enables the cool air to flow smoothly. Preferably, the length of the fan 44 corresponds to the inner width of the refrigerating chamber 200, and is operated by an additional motor 46.

The exit 153 is bent facing a lower portion of the refrigerating chamber 200, and if required, may be bent at a desired angle about a vertical direction of the refrigerating chamber 200. Also, it is desirable that the exit 153 is formed along the entire width of an access opening of the refrigerating chamber 200.

Furthermore, a partition plate 420 is provided in the cool air supply duct 150 along a longitudinal direction of the supply duct 150 for dually separating the air curtain stream.

The cool air supply duct 150 is divided into an upper air passage 151 and a lower air passage 152 by the partition plate 420, and a cross-section of the upper air passage 151 is smaller than that of the lower air passage 152. Thus, flow velocity of the cool air passing through the upper air passage 151 is faster than that of the cool air passing through the lower air passage 152.

As a result, the cool air discharged from the upper air passage 151 forms an outer stream layer for restraining the entry of ambient air, and the cool air discharged from the lower air passage 152 forms an inner stream layer maintaining a cold state and circulating the refrigerating chamber 200 inside.

A cool air collecting duct 147 is vertically extended along rear central portion. A plurality of cool air collecting opening 148, 148A, 148B are arranged at a plurality of storage spaces 145, 145A, 145B respectively, and are communicated with the cool air collecting duct 147.

A cross-section of the upper cool air collecting opening 148 is smaller than that of the middle cool air collecting opening 148A, and a cross-section of the middle cool air collecting opening 148A is smaller than that of the lower cool air collecting opening 148B.

Each cool air collecting opening 148, 148A, 148B is formed at a rear upper portion of each storage space 145, 145A, 145B considering an occupying volume of the stored foods, and has an oval shape.

Each storage space 145, 145A, 145B of the refrigerating chamber 200 is defined by a plurality of shelves 149, 149A, 149B, and top surfaces of an upper shelf 149 and a middle shelf 149A are flatly formed for smoothly collecting the cool air of the air curtain stream.

Furthermore, an upper curved lip is provided at a front face of the lower shelf 149B installed on an upper portion of a vegetable container, thereby effectively guiding one part of the cool air of the air curtain into the refrigerating chamber 200. The lip 52 is integrally formed by bending upward from the front face of the lower shelf 149B.

Hereinafter, the operation of the first preferred embodiment according to the present invention will be described.

Figure 4:
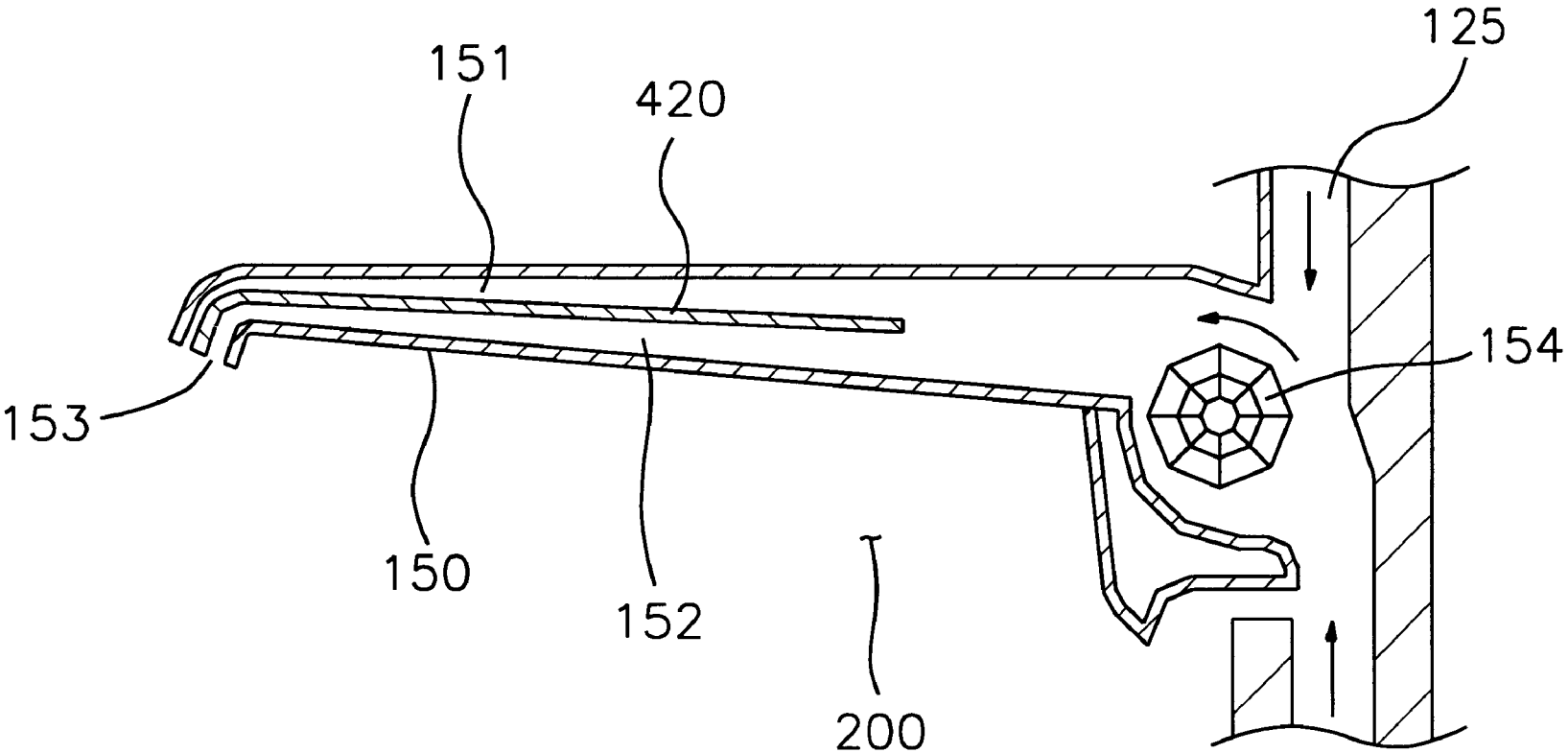
FIG. 4 is an enlarged side cross-sectional view of the cool air supply duct of FIG. 3.

FIG. 4 is an enlarged side cross-sectional view of the cool air supply duct of FIG. 3.

As shown in FIG. 4, when a door (not shown) opens during the operation of the refrigerator, the door switch senses an opening of the door and then the cross flow fan commences the operation. The cool air flowing from the cool air duct 125 is forcedly ventilated into the cool air supply duct 150 by the cross flow fan 154. The ventilated cool air is injected from the upper portion of the access opening of the refrigerating chamber 200 to the lower portion of the access opening through the exit 153 via the upper air passage 151 and the lower air passage 152 divided by the partition plate 420.

At this time, because the cross-section of the upper air passage 151 is smaller than that of the lower air passage 152, the cool air discharged from the upper air passage 151 forms the outer stream layer 500 having the fast flow velocity, and the cool air discharged from the lower air passage 152 forms the inner stream layer 510 having the slow flow velocity. Also, the amount of cool air discharged from the lower air passage 152 is larger than that of the cool air discharged from the upper air passage 151 due to the difference of the cross-section between the upper air passage 151 and the lower air passage 152.

Accordingly, the outer stream layer 500 having the fast flow velocity restrains the invasion of ambient air, and the inner stream layer 510 having a slow flow velocity and a large quantity of cool air enters into each of the storage spaces 145, 145A, circulates inside of the refrigerating chamber 200, and then flows into the cool air collecting duct 147 through the cool air collecting openings 148, 148A.

Figure 5:
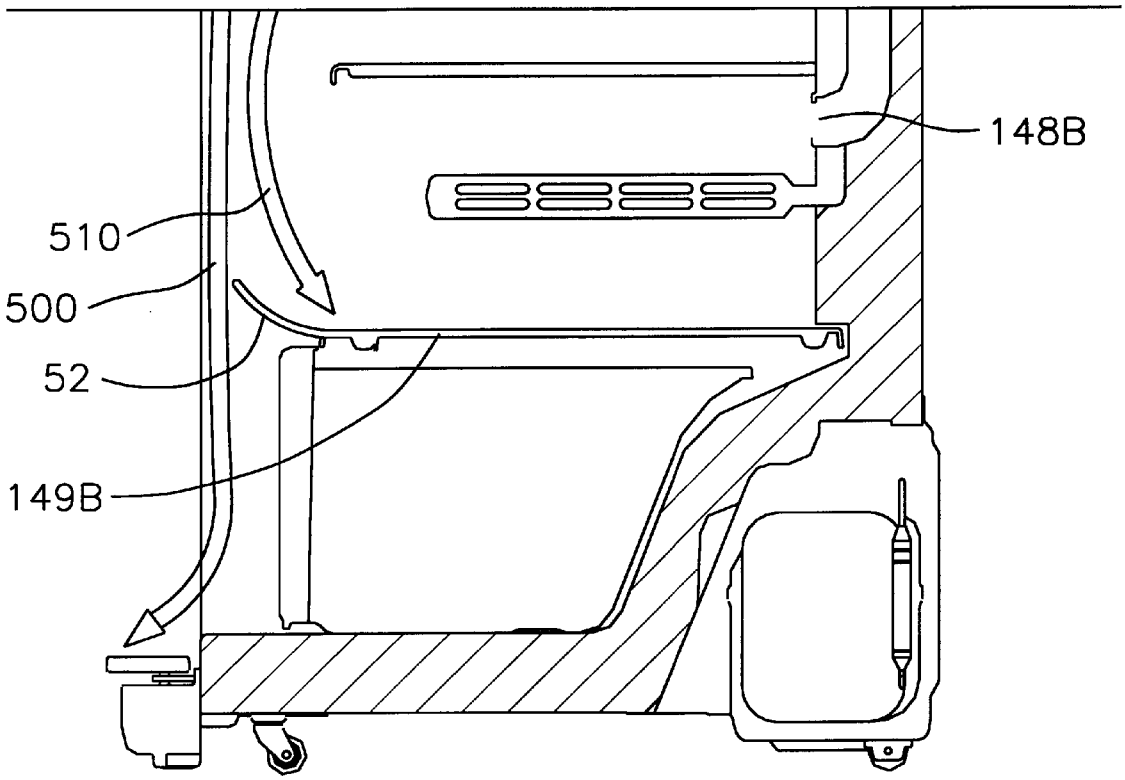
FIG. 5 is an enlarged side cross-sectional view of air curtain streams of FIG. 3.

FIG. 5 is an enlarged side cross-sectional view of air curtain streams of FIG. 3.

As shown in FIG. 5, the cool air of the air curtain discharged from the upper portion of the access opening to the lower portion of the access opening flows in dually separated streams by the upper curved lip 52 formed at the front face of the lower shelf 149B. Thus, the outer stream layer 500 of which the temperature rises due to contact with ambient air is discharged out through the lower portion of the refrigerating chamber 200, and the inner stream layer 510 formed with a large amount of cool air is guided toward the inside of the refrigerating chamber 200 and then is circulated through the cool air collecting openings.

As a result, the upper curved lip 52 smoothly guides the large amount of cool air into the lower storage space 145B due to being protruded toward the access opening of the refrigerating chamber 200.

As described above, because the outer stream layer 500 of which the temperature rises due to contact with ambient air is discharged out through the lower portion of the refrigerating chamber 200, and the inner stream layer 510 is guided toward the inside of the refrigerating chamber 200 and then is circulated through the cool air collecting openings, even though the door of the refrigerating chamber 200 is opened for a long time, the temperature of the refrigerating chamber 200 does not rise.

The length and the center of curvature of the lip 52 may be designed according to the refrigerator size, and the velocity of the cross flow fan 154 and the cross-section ratio of the upper air passage 151 and the lower air passage 152 may be changed.

Accordingly, any outflow of the cool air from the refrigerating chamber 200 is minimal, and thus power consumption of the refrigerator is reduced, resulting in improving energy efficiency. Also, the temperature in the refrigerating chamber 200 is constantly maintained, and thus freshness of stored food can be maintained for a long time.

While this invention has been particularly shown and described with reference to particular embodiments thereof, it will be understood by those skilled in the art that various changes in form and detail may be effected therein without departing from the spirit and scope of the invention as defined by the appended claims.

What is claimed is:

1. A cool air circulation apparatus in a refrigerator comprising:

a refrigerator having an access opening at a front portion, in which a plurality of shelves are transversely provided in stacking type;

a cool air supply duct installed on an upper portion of the access opening and discharging the cool air from the upper portion of the access opening toward a lower portion of the access opening;

a cross flow fan installed in an inlet part of the cool air supply duct and forcedly ventilating the cool air;

a cool air collecting duct, one side of which is extended toward the cross flow fan and another side of which is communicated with a plurality of cool air collecting openings formed between the shelves; and an upper curved lip facing the cool air supply duct at a front face of the lowest shelf among the shelves, thereby guiding one portion of the cool air into the refrigerating chamber.

2. The cool air circulation apparatus in a refrigerator according to claim 1, wherein said cool air supply duct has a partition plate longitudinally extended in the cool air supply duct and dividing the cool air supply duct into an upper air passage and a lower air passage.

3. The cool air circulation apparatus in a refrigerator according to claim 2, wherein a traverse cross-section of the upper air passage is smaller than that of the lower air passage.

4. A cool air circulation apparatus in a refrigerator comprising:

a refrigerator having an access opening at a front portion, in which a plurality of shelves are transversely provided in stacking type;

a cool air supply duct installed on an upper portion of the access opening and discharging the cool air from the upper portion of the access opening toward a lower portion of the access opening wherein the cool air supply duct is divided into an upper air passage and a lower air passage having a cross-section larger than that of the upper air passage by a partition plate longitudinally extended in the cool air supply duct;

a cross flow fan installed in an inlet part of the cool air supply duct and forcedly ventilating the cool air;

a cool air collecting duct, one side of which is extended toward the cross flow fan and another side of which is communicated with a plurality of cool air collecting openings formed between the shelves; and an upper curved lip facing the cool air supply duct at a front face of the lowest shelf among the shelves, thereby guiding one portion of the cool air into the refrigerating chamber.

* * * * *